US009890977B2

(12) United States Patent
Li et al.

(10) Patent No.: US 9,890,977 B2
(45) Date of Patent: Feb. 13, 2018

(54) FLASH TANK ECONOMIZER FOR TWO STAGE CENTRIFUGAL WATER CHILLERS

(71) Applicant: Carrier Corporation, Farmington, CT (US)

(72) Inventors: Hsihua Li, Huntersville, NC (US); Haiping Ding, Shanghai (CN)

(73) Assignee: Carrier Corporation, Jupiter, FL (US)

( * ) Notice: Subject to any disclaimer, the term of this patent is extended or adjusted under 35 U.S.C. 154(b) by 489 days.

(21) Appl. No.: 14/504,950

(22) Filed: Oct. 2, 2014

(65) Prior Publication Data

US 2015/0096315 A1 Apr. 9, 2015

Related U.S. Application Data

(60) Provisional application No. 61/886,610, filed on Oct. 3, 2013.

(51) Int. Cl.
*F25B 39/04* (2006.01)
*F25B 43/00* (2006.01)
(Continued)

(52) U.S. Cl.
CPC ..... *F25B 43/00* (2013.01); *F25B 1/005* (2013.01); *F25B 25/005* (2013.01);
(Continued)

(58) Field of Classification Search
CPC ..... F25B 43/00; F25B 43/02; F25B 2400/13; F25B 2400/23; F25B 1/10; F25B 1/047; F25B 1/02
See application file for complete search history.

(56) References Cited

U.S. PATENT DOCUMENTS 3,365,900 A 1/1968 Clark et al.
4,142,381 A 3/1979 Lavigne, Jr.
(Continued)

FOREIGN PATENT DOCUMENTS

EP 1740894 B1 6/2009
WO 2008-042358 A1 4/2008

OTHER PUBLICATIONS

Product Data: 17/19EX Centrifugal Liquid Chiller 50/60 Hz, 1995, Carrier Corporation, Syracuse, NY.
(Continued)

*Primary Examiner* — Elizabeth Martin
(74) *Attorney, Agent, or Firm* — Bachman & LaPointe, P.C.

(57) ABSTRACT

A system comprises the integrated combination of: a condenser having a condenser water path leg extending from a water inlet to a water outlet; a first expansion device; a flash tank economizer; a second expansion device; an evaporator having an evaporator water path leg extending from a water inlet to a water outlet; and a refrigerant flowpath passing sequentially through the condenser, the first expansion device, the economizer, the second expansion device and the evaporator. The flash tank economizer comprises a horizontally elongate body having a first end and a second end. The economizer has an inlet conduit having an outlet. The economizer has a liquid outlet, a vapor outlet, and a medium between the outlet of the inlet conduit and the liquid outlet. A length of the refrigerant flowpath between the first expansion device and the outlet of the inlet conduit is at least 0.5 m.

20 Claims, 5 Drawing Sheets

(51) Int. Cl.
*F25B 1/00* (2006.01)
*F25B 25/00* (2006.01)

(52) U.S. Cl.
CPC . *F25B 2339/047* (2013.01); *F25B 2341/0662* (2013.01); *F25B 2400/13* (2013.01); *F25B 2400/23* (2013.01); *F25B 2500/01* (2013.01)

(56) References Cited

U.S. PATENT DOCUMENTS 4,209,061 A * 6/1980 Schwemin ..... F02G 1/057 165/10
4,232,533 A * 11/1980 Lundblad ..... F25B 1/10 62/509
5,209,080 A 5/1993 Zinsmeyer
5,285,653 A 2/1994 Meloling et al.
5,417,078 A 5/1995 Huenniger et al.
5,634,350 A 6/1997 De Medio
5,692,389 A 12/1997 Lord et al.
6,941,769 B1 9/2005 Hill, IV et al.
8,434,323 B2 5/2013 Welch et al.
8,485,789 B2 7/2013 Gu et al.
2002/0157409 A1 10/2002 Pham et al.
2005/0188708 A1 9/2005 Wills et al.
2006/0201188 A1 9/2006 Kopko
2008/0286118 A1 11/2008 Gu et al.
2009/0205360 A1* 8/2009 Haley ..... F04D 17/122 62/498
2010/0326130 A1* 12/2010 Takada ..... F25B 1/10 62/510
2011/0139794 A1 6/2011 Pham et al.
2013/0031934 A1 2/2013 Huff et al.
2013/0055637 A1 3/2013 Ariyapadi et al.
2013/0111934 A1 5/2013 Wang et al.

OTHER PUBLICATIONS

Evergreen 23XRV High-Efficiency Variable Speed Screw Chiller with Foxfire Compression Technology and PIC III Controls 50/60 Hz HFC-134a, Start-Up Operation and Maintenance Instructions, 2012, Carrier Corporation, Syracuse, NY.
Centrifugal Water Chillers, A Trane Air Conditioning Clinic, 1999, American Standard Inc., Piscataway, NJ.
Graphics Catalog RCD-3519-060, Hermetic Centrifugal Liquid Chiller 19FA, 2000, Carrier Corporation, Syracuse, NY.

* cited by examiner

FLASH TANK ECONOMIZER FOR TWO STAGE CENTRIFUGAL WATER CHILLERS

CROSS-REFERENCE TO RELATED APPLICATION

Benefit is claimed of U.S. Patent Application Ser. No. 61/886,610, filed Oct. 3, 2013, and entitled "Flash Tank Economizer for Two Stage Centrifugal Water Chillers", the disclosure of which is incorporated by reference herein in its entirety as if set forth at length.

BACKGROUND

The disclosure relates to refrigeration. More particularly, the disclosure relates to economized chiller systems.

A typical chiller system comprises a vapor compression refrigeration system having a compressor, a condenser, and an evaporator along a recirculating refrigeration flowpath. An expansion device is between condenser and evaporator. Exemplary condensers and evaporators are refrigerant-water heat exchangers so that refrigerant compressed by the compressor is cooled in the condenser by transferring heat to a first water loop. Refrigerant is further cooled by expansion in the expansion device and absorbs heat in the evaporator from a second water loop.

An economizer may be added to the system to reduce the vapor percentage of refrigerant delivered to the evaporator, thereby increasing the latent heat of refrigerant delivered to the evaporator. An exemplary economizer is a flash tank economizer wherein a portion of the refrigerant delivered from the condenser is expanded (flashed) into a vapor portion, leaving a liquid portion. The vaporized refrigerant is returned to an economizer port along the compressor. The expansion further cools the liquid refrigerant prior to its delivery to the primary expansion device and then the evaporator. Two exemplary economized chillers are the models 19EX and 23XRV of Carrier Corporation, Syracuse, N.Y., USA.

SUMMARY

One aspect of the disclosure involves a system comprising the integrated combination of: a condenser having a condenser water path leg extending from a water inlet to a water outlet; a first expansion device; a flash tank economizer; a second expansion device; an evaporator having an evaporator water path leg extending from a water inlet to a water outlet; and a refrigerant flowpath passing sequentially through the condenser, the first expansion device, the economizer, the second expansion device and the evaporator. The flash tank economizer comprises a horizontally elongate body having a first end and a second end. The economizer has an inlet conduit having an outlet. The economizer has a liquid outlet, a vapor outlet, and a medium between the outlet of the inlet conduit and the liquid outlet. A length of the refrigerant flowpath between the first expansion device and the outlet of the inlet conduit is at least 0.5 m.

In one or more embodiments of any of the foregoing embodiments, the outlet of the inlet conduit faces the first end and the liquid outlet is proximate the second end.

In one or more embodiments of any of the foregoing embodiments, the medium comprises a pair of perforated plates.

In one or more embodiments of any of the foregoing embodiments, the plates are parallel and spaced-apart from each other.

In one or more embodiments of any of the foregoing embodiments, the plates spaced-apart from each other by a gap of 10 mm to 25 mm.

In one or more embodiments of any of the foregoing embodiments, the plates comprise a first plate and a second plate and holes of the first plate are offset from holes of the second plate.

In one or more embodiments of any of the foregoing embodiments, the medium comprises a third plate having holes offset from holes of the first plate.

In one or more embodiments of any of the foregoing embodiments, the holes of the third plate are aligned with the holes of the second plate.

In one or more embodiments of any of the foregoing embodiments, the holes of the first plate and the holes of the second plate are circular in a square array.

In one or more embodiments of any of the foregoing embodiments, the holes of the first plate and holes of the second plate are circular in planform and of the same diameter and the square array has an on-center spacing ($X_{10}$) being 141% to 300% of the hole diameter ($D_{10}$).

In one or more embodiments of any of the foregoing embodiments, the economizer comprises a vessel having a main cylinder extending from the first end toward the second end and a second cylinder at the second end and forming a sump, the liquid outlet extending from the sump.

In one or more embodiments of any of the foregoing embodiments, the economizer lacks a spray bar and a wire mesh-type demister.

In one or more embodiments of any of the foregoing embodiments, the system has a compressor. The compressor has: an outlet upstream of the condenser along the refrigerant flowpath; a suction port downstream of the second expansion device along a first branch of the refrigerant flowpath; and an economizer port downstream of the economizer vapor outlet along a second branch of the refrigerant flowpath.

In one or more embodiments of any of the foregoing embodiments, the system is a chiller.

In one or more embodiments of any of the foregoing embodiments, a method for using the system comprises: running the compressor to draw refrigerant from the suction port and the economizer port, compress said refrigerant, and drive the refrigerant downstream from the outlet along the refrigerant flowpath; rejecting heat from the refrigerant in the condenser to water flowing along the condenser water path leg; after the rejecting, expanding the refrigerant in the first expansion device; passing the expanded refrigerant from the first expansion device to the flash tank economizer; passing a first branch flow of the refrigerant from the flash tank economizer back to the economizer port; passing a second branch flow of the refrigerant to the second expansion device; passing the expanded refrigerant from the second expansion device to the evaporator; absorbing heat by refrigerant passing through the evaporator from water passing along the evaporator water path leg; and returning refrigerant from the evaporator to the suction port.

In one or more embodiments of any of the foregoing embodiments, the medium is effective to remove droplets of liquid refrigerant from a vapor flow passing to the vapor outlet and deliver said droplets to a liquid accumulation for forming a liquid flow from the liquid outlet.

In one or more embodiments of any of the foregoing embodiments, refrigerant discharged from the inlet conduit outlet is deflected off an interior surface of the body at the first end.

Another aspect of the disclosure involves an economizer comprising: an elongate body having a first end and a second end; an inlet conduit having an outlet; a liquid outlet; a vapor outlet; and first and second spaced-apart foraminate plates between the outlet of the inlet conduit and the liquid outlet.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
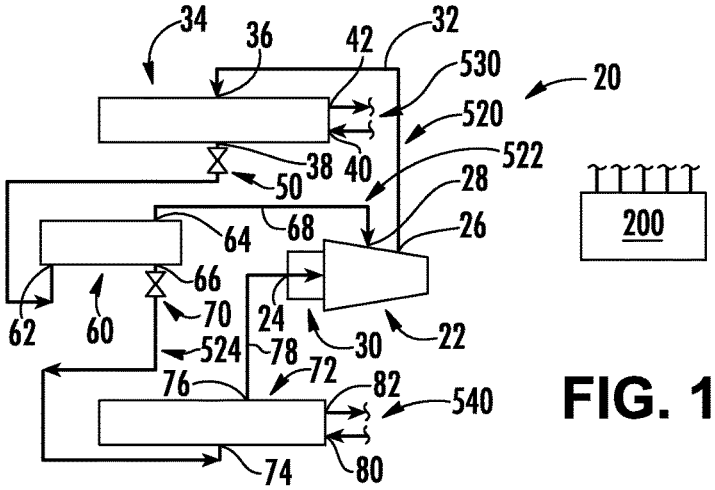
FIG. 1 is a schematic view of a chiller system.

FIG. 1 shows a chiller system 20 having a vapor compression circuit or system including a compressor 22 having a fluid (refrigerant) primary inlet 24 and a refrigerant primary outlet 26. The exemplary compressor includes an intermediate port or economizer port 28, intermediate the ports 24 and 26 along a compression path within the compressor. In the case of reciprocating compressors, the economizer port maybe at an interstage between multiple cylinders. In the case of screw compressors, this may be open to the compression pockets at an intermediate stage of compression. In the case of multi-stage centrifugal compressors, the economizer port may be between stages (e.g., between the first stage impeller and a second stage impeller).

The exemplary compressor has an electric motor 30 for driving the working element(s) such as pistons, screws, impeller(s) and the like. The compressor discharge line 32 extends downstream from the discharge port 26 along a refrigerant primary flowpath to a refrigerant inlet port 36 of a heat exchanger 34. In a normal operating mode, the heat exchanger 34 is a heat rejection heat exchanger also known as a condenser or gas cooler. The heat exchanger 34 has a refrigerant outlet 38 along the refrigerant primary flowpath.

The heat exchanger 34 also includes ports for receiving and discharging a heat transfer fluid. Exemplary heat transfer fluid is a liquid, more particularly water, flowing along a loop or flowpath 530. Depending upon the implementation, the flowpath 530 may be an open flowpath or a closed/recirculating flowpath. FIG. 1 shows a water inlet port 40 and a water outlet port 42 of the condenser along the flowpath 530 so that water flowing along the flowpath 530 within the heat exchanger 34 is in heat exchange relationship with refrigerant passing along the primary flowpath 520 within the heat exchanger 34. In the normal operating mode, heat is transferred from the refrigerant to the water (or other fluid) to elevate the temperature of the discharge water relative to inlet water and to reduce the temperature of discharged refrigerant relative to inlet refrigerant.

Downstream of the heat exchanger 34 along the primary flowpath 520 is an expansion device 50. The expansion device 50 serves as an economizer expansion device as described below. An exemplary expansion device 50 is an electronic expansion device which may be controlled by a system controller 200 described below.

Downstream of the expansion device 50 along the primary flowpath 520 is an economizer 60. An exemplary economizer 60 is a flash tank economizer having an inlet port 62 and outlet ports 64 and 66. The exemplary outlet port 64 is a vapor outlet for returning vaporous refrigerant to the economizer port 28 via an economizer line 68 along an economizer branch 522 of the refrigerant flowpath. The outlet port 66 is a liquid outlet port for discharging liquid refrigerant along flowpath branch 524, ultimately returning to the compressor inlet port 24.

In typical implementations, the majority of the mass flow of refrigerant along the primary flowpath 520 will be carried by the branch 524. Accordingly, the branch 524 may, alternatively, be characterized as a continuation of the primary flowpath with the branch 522 being a bypass/diversion/branch thereof. An expansion device 70 is along the flowpath 524 downstream of the outlet 66 and upstream of a refrigerant inlet 74 of a heat exchanger 72. In the normal operating mode, the heat exchanger 72 is a heat absorption heat exchanger (evaporator or cooler) having an outlet 76 discharging refrigerant to a suction line 78 to return the refrigerant to the compressor inlet 24. The exemplary heat exchanger 72 is also a refrigerant-water heat exchanger transferring heat from a water flowpath or loop 540 via a water inlet 80 and a water outlet 82 in similar fashion to the heat exchanger 36 and its associated water loop 530.

Expansion of the refrigerant in the device 50 reduces the temperature of the refrigerant. Accordingly, the liquid refrigerant delivered to the expansion device 70 will be colder than the liquid refrigerant discharged from the heat exchanger 34. This allows the expanded refrigerant delivered to the evaporator to be cooler than if there was merely a single stage expansion of refrigerant from the heat exchanger 34 being delivered to the heat exchanger 72.

FIG. 1 further shows a controller 200. The controller may receive user inputs from an input device (e.g., switches, keyboard, or the like) and sensors (not shown, e.g., pressure sensors and temperature sensors at various system locations). The controller may be coupled to the sensors and controllable system components (e.g., the expansion device and other valves, the bearings, the compressor motor, vane actuators, and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

Figure 2:
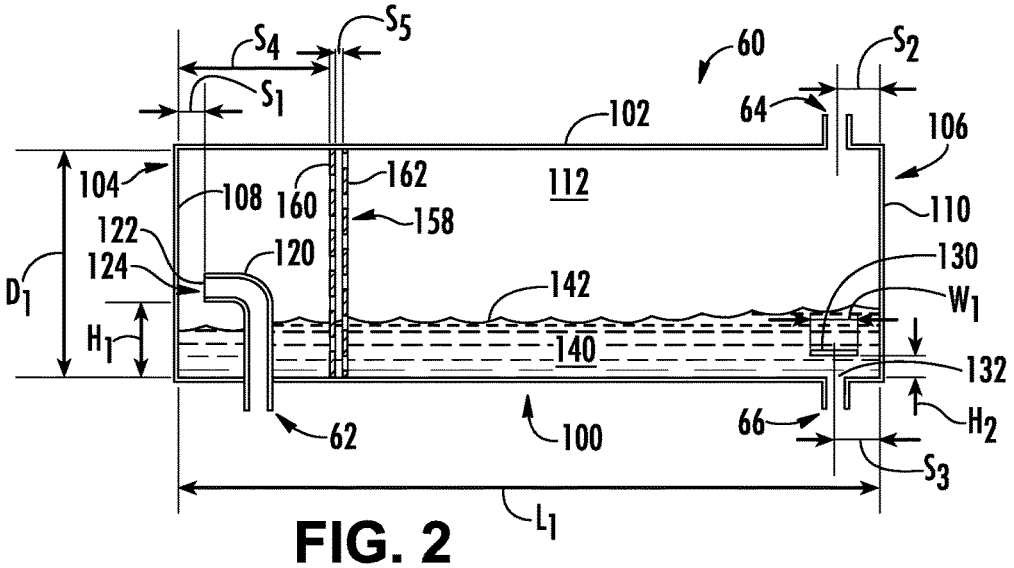
FIG. 2 is a partially schematic central longitudinal vertical sectional view of a first economizer.

FIG. 2 shows further details of an exemplary economizer 60.

The exemplary economizer 60 comprises an elongate vessel 100 having a sidewall 102 (e.g., circular cylindrical) extending between a first rim at a first end 104 and a second rim at a second end 106. Respective end walls 108 and 110 are secured to the sidewall proximate the ends 104 and 106. Exemplary end walls are flat plates or outwardly convex domes. The exemplary overall length of an interior 112 of the vessel is shown as $L_1$. An exemplary interior diameter is shown as $D_1$. Exemplary $D_1$ is 0.5 m, more broadly, 0.3 m to 1.0 m or 0.4 m to 0.7 m. Exemplary $L_1$ is 2 m or 1.6 m to 2.4 m, more broadly, 1 m to 4 m or 1.0 m to 2.5 m. Exemplary $L_1$ is three to six times $D_1$, more particularly, 3.0 to 5.0 times.

FIG. 2 also shows an inlet conduit 120 extending into the interior 112 from the inlet 62 and terminating in an inlet conduit opening or outlet 122 (e.g., a single circular outlet) for discharging a flow 124. Exemplary outlet 122 is in close facing proximity to the wall 108 (inlet end wall). For example, the outlet 122 may be spaced by a distance $S_1$ away from the adjacent surface of the wall 108. The exemplary outlet is spaced above a bottom of the vessel by a height $H_1$.

The exemplary ports 64 and 66 are formed in the sidewall 102 at respective lower and upper extremities thereof and have respective on-center spacings from the associated rim of the sidewall 102 of $S_2$ and $S_3$. FIG. 2 also shows a vortex breaker 130 spaced apart from the sidewall outlet opening 132 (associated with the outlet port 66) by a height of $H_2$ The vortex breaker helps provide a liquid seal by stopping swirling to prevent vapor entrainment in the liquid outlet flow. The exemplary vortex breaker 130 is shaped as a rectangular plate (i.e., as a chord) spanning the sidewall and has a longitudinal dimension of $W_1$.

FIG. 2 further shows a liquid refrigerant accumulation 140 within the interior 112 and having an upper surface 142.

It is desirable that refrigerant discharged from the outlet port 64 be pure vapor or close thereto. It is similarly desirable that refrigerant discharged from outlet port 66 be pure liquid or close thereto. Accordingly, it is desirable to configure the economizer to minimize vapor bubbles in the liquid refrigerant adjacent the opening 132 and minimize liquid droplets reaching the outlet 64.

The flow 124 discharged from the inlet conduit outlet 122 will be mixed phase. Advantageously, the liquid and vapor phases in the flow 124 are in thermal equilibrium. This may be achieved by placing the expansion device 50 well upstream of the outlet 122. Initially, at expansion by the expansion device 50, the vapor will be cooler than the liquid. By providing a sufficient length of primary flowpath 520 between the expansion device 50 and the outlet 122 there is time for the two phases to equilibrate. The exemplary length between the expansion device 50 and the outlet 122 is at least 0.5 m, more particularly at least 0.8 m or 0.8 m to 2.0 m.

The discharged flow 124 will deflect off the interior surface of the wall 108. Liquid will tend to collect on wall 108 by inertia and flow downward while the vapor is deflected and drawn by pressure difference toward the outlet 64. Gravity will tend to draw the liquid downward into the accumulation 140. There will be substantial turbulence in the accumulation near the wall 108 and thus some residual intermixing of vapor in the liquid.

In the exemplary implementation a foraminate member 158 in the form of multiple foraminate plates (e.g., a pair of perforated plates 160, 162) is positioned spanning the interior of the housing slightly downstream of the inlet conduit. In the exemplary embodiment, the first plate 162 is spaced by a distance $S_4$ from the inlet end rim of the sidewall 102. Exemplary $S_4$ is less than half of $L_1$, more particularly less than a third of $L_1$, and, more particularly about 15% to 25% of $L_1$.

Exemplary spacing between the plates is shown as $S_5$. Exemplary $S_5$ is small. An exemplary spacing is the thickness of a gap between plates rather than the on-center spacing. The small spacing combined with the offset of holes in the respective plates serves to prevent any residual high speed droplets from passing through the pair and reaching the outlet 64. Any droplet passing through a hole in the first plate 160 will impact the second plate 162 and will then flow downward into the accumulation 140. Any droplet hitting the plate 160 will flow down the upstream face of the plate 160 and then into the accumulation. There may be greater splashing/reflection of droplets but the same principle generally applies.

Within the accumulation 140, the interruption provided by the plates helps reduce sloshing and facilitates having a lower concentration of vapor in the liquid to the outlet discharge side of the plates compared to the inlet/upstream side of the plates. The combination of the outlet 122 directing flow against a vessel interior wall and the intervening media or foraminate member 158 may avoid the expense of an economizer having a spray bar in combination with a wire mesh demister.

Figure 3:
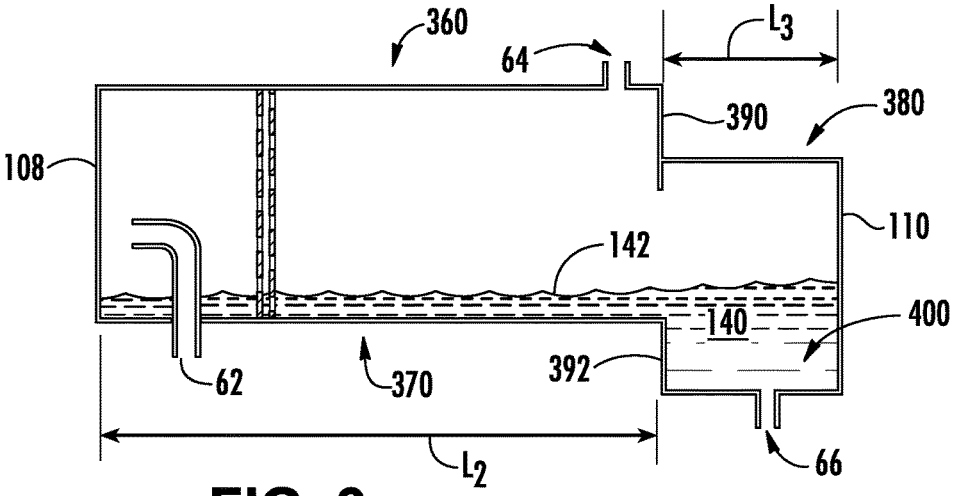
FIG. 3 is a partially schematic central longitudinal vertical sectional view of a second economizer.

FIG. 3 shows an alternative economizer 360 formed with a dual-cylinder vessel configuration. A main or primary cylinder 370 extends downstream from an upstream end and contains the inlet conduit and perforated plates in similar fashion to the FIG. 2 embodiment. At the downstream/discharge end, however, there are differences. The second shorter cylinder 380 of similar diameter to the first cylinder is end-to-end with the first cylinder but downwardly shifted relative thereto to provide an increased depth of sump 400. The liquid outlet 66 thus extends from the second cylinder/sump. The main cylinder thus has a partial downstream wall 390 closed relative to the exterior but open to the interior of the second cylinder. Similarly, the second cylinder has an upstream end wall 392 closed to the exterior but open to the main cylinder.

Figure 4:
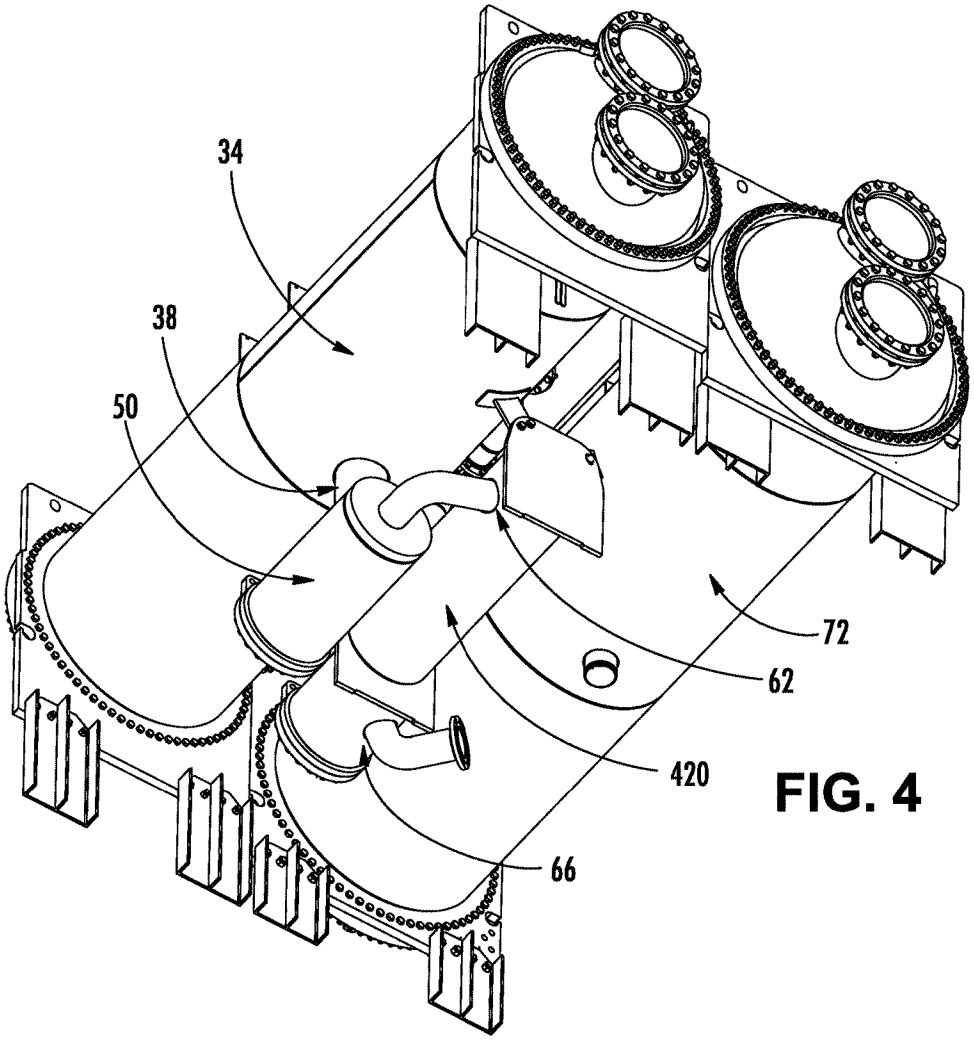
FIG. 4 is a bottom perspective view of an integrated condenser/economizer/evaporator unit.
Figure 5:
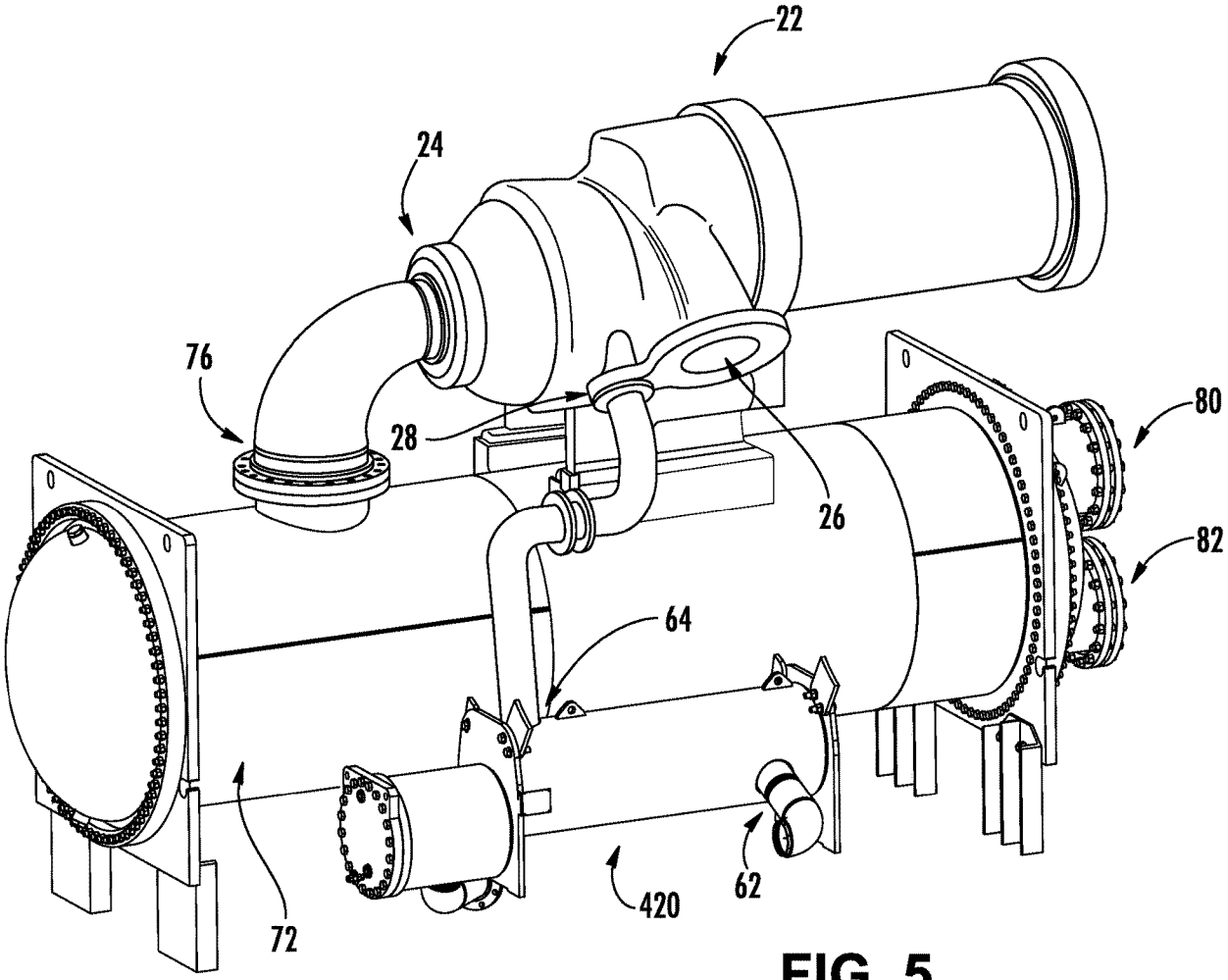
FIG. 5 is a partial perspective view of the unit of FIG. 4 with condenser removed.

FIGS. 4 and 5 show the integration of an economizer 420 with the heat exchangers 34 and 72. Having a horizontally elongate economizer provides for a compact integration with horizontally elongate heat exchangers.

Although the exemplary economizer 420 has slightly different internal features relative to the more schematically illustrated economizers 60 and 360, shared features are referenced with shared reference numerals. In the exemplary illustration, the economizer main or primary cylinder 370 is nested in the valley or cusp below and between the cylindrical bodies of the condenser 34 and evaporator 72. In the exemplary implementation, the condenser is slightly vertically offset relative to the evaporator (e.g., by less than the radius of either).

Figure 6:
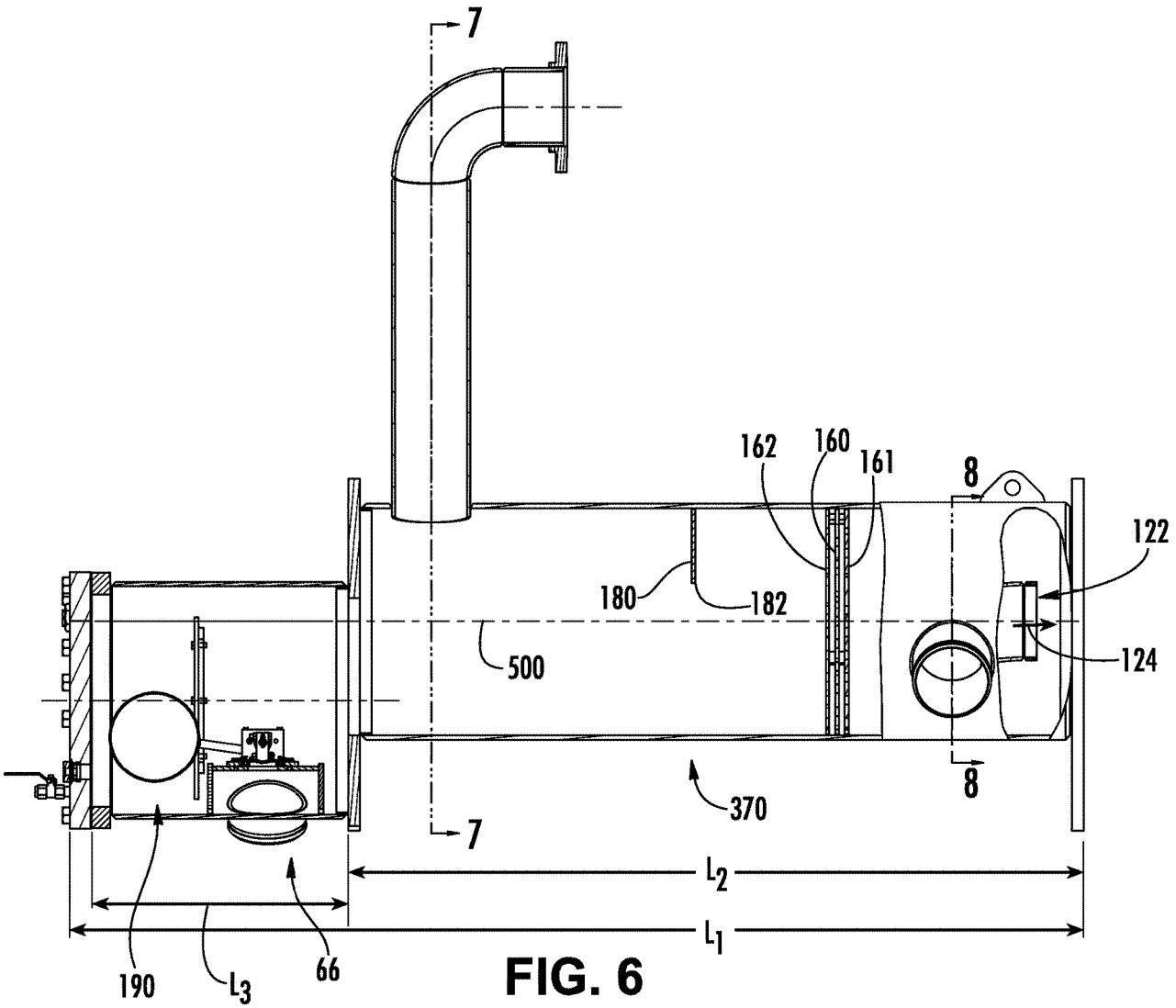
FIG. 6 is an axial partially vertically cutaway view of the economizer of the unit of FIG. 4.
Figure 7:
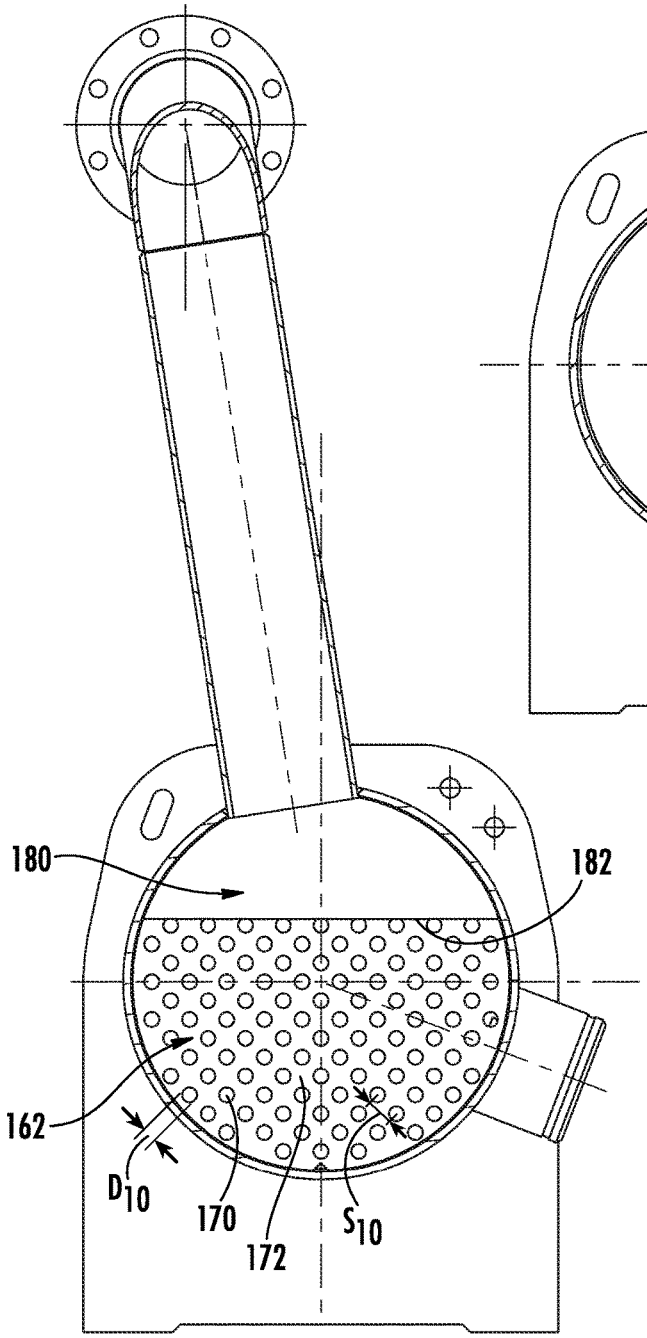
FIG. 7 is a transverse sectional view of the economizer of FIG. 6, taken along line 6-6.
Figure 8:
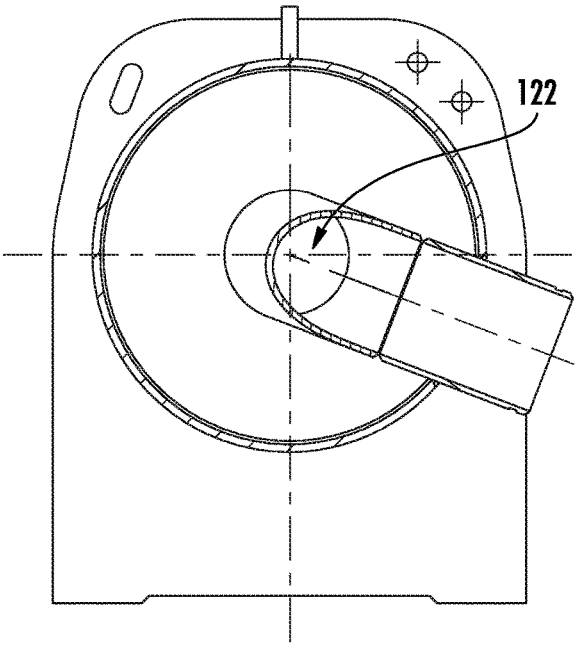
FIG. 8 is a transverse sectional view of the economizer of FIG. 6, taken along line 8-8 of FIG. 6.

FIGS. 6 and 8 show the outlet 122 centered along the centerline 500 of the primary cylinder 370. Additionally, the illustrated foraminate member comprises three plates instead of two. For arbitrary purposes of reference, the additional plate 161 is at the inlet end of the plate group. The holes in each plate are out of phase with the holes in the next. In this example, therefore, the holes in the plates 161 and 162 at respective ends of the group of three plates have holes in phase with each other. In an exemplary situation, the holes 170 (FIG. 7) are in a square array. Thus, the holes 170 of a given plate are aligned with the intact inter-hole areas 172 (e.g., centered between a group of four holes) of the next plate. Exemplary hole diameter $D_{10}$ is approximately half or slightly less than half of the on-center spacing $S_{10}$ of the holes along the two directions of the square array. Because the holes are out of phase in both directions of the square array, the transverse dimensions of the intact areas are greater than the hole diameter even with hole diameter equal to half of $S_{10}$. Accordingly, any liquid passing through one hole will tend to hit the next plate (either on intact surface or sides of a hole) and lose momentum.

Exemplary plate thickness is 7 mm, more broadly, 5 mm to 10 mm. Exemplary hole diameter $D_{10}$ is 19 mm, more broadly, 10 mm to 30 mm or 15 mm to 25 mm. Exemplary grid spacing $S_{10}$ is 38 mm, more broadly, 15 mm to 100 mm or 20 mm to 60 mm or 141%-300% of $D_{10}$ or 150% to 250% of $D_{10}$. Exemplary gap thickness $S_5$ between plates is 13 mm, more broadly, 5 mm to 30 mm or 10 mm to 25 mm or 10 mm to 20 mm.

FIG. 6 further shows a deflector plate 180 extending vertically downward within the vessel 370 between the plates and the vapor outlet. The exemplary plate 180 has a lower edge 182. Exemplary lower edge 182 forms a chord of the cross-section of the vessel 370 and has edges welded to the vessel interior. The exemplary edge 182 is spaced horizontally partially above the horizontal centerplane of the vessel (e.g., by an eighth to a half of the vessel inner diameter). The exemplary plate 180 serves as a further baffle or barrier to collect and/or deflect any yet residual droplets which have passed through the foraminate member.

FIG. 6 also shows a float valve assembly 190 for controlling flow from the liquid outlet. This functions as the primary expansion device 70.

Exemplary manufacture techniques and materials may be those conventionally used for economizers and other chiller components (evaporator, condenser, and the like). Similarly, exemplary use steps may be conventional. Exemplary vessel material is metal such as steel (e.g., carbon steel) meeting American Society of Mechanical Engineers (ASME) code. Similar material may be used for the perforated plates, other plates, conduits and the like. Such metal allows ease of manufacture, cutting, forming welding, and the like.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A system (20) comprising an integrated combination of:
- a condenser (34) having a condenser water path leg extending from a water inlet (40) to a water outlet (42);
- a first expansion device (50);
- a flash tank economizer (60; 360; 420);
- a second expansion device (70; 190);
- an evaporator (72) having an evaporator water path leg extending from a water inlet (80) to a water outlet (82); and
- a refrigerant flowpath (520, 522, 524) passing sequentially through the condenser, the first expansion device, the economizer, the second expansion device and the evaporator, wherein:
- the flash tank economizer comprises:
  - a horizontally elongate body having a first end (108) and a second end (110);
  - an inlet conduit (120) having an outlet (122);
  - a liquid outlet (66);
  - a vapor outlet (64); and
  - a medium (158) between the outlet of the inlet conduit and the liquid outlet; and
- a length of the refrigerant flowpath between the first expansion device and the outlet of the inlet conduit is at least 0.5 m.

2. The system of claim 1 wherein:
- the outlet of the inlet conduit faces the first end; and
- the liquid outlet is proximate the second end.

3. The system of claim 1 wherein:
- the medium comprises a pair of perforated plates (160, 162).

4. The system of claim 3 wherein:
- the plates are parallel and spaced-apart from each other.

5. The system of claim 3 wherein:
- the plates spaced-apart from each other by a gap of 10 mm to 25 mm.

6. The system of claim 4 wherein:
- the plates comprise a first plate (160) and a second plate (162) and holes (170) of the first plate are offset from holes (170) of the second plate.

7. The system of claim 6 wherein:
- the medium comprises a third plate (161) having holes offset from holes of the first plate.

8. The system of claim 7 wherein:
- the holes of the third plate are aligned with the holes of the second plate.

9. The system of claim 6 wherein:
- the holes of the first plate and the holes of the second plate are circular in a square array.

10. The system of claim 9 wherein:
- the holes of the first plate and holes of the second plate are circular in planform and of the same diameter; and
- the square array has an on-center spacing ($S_{10}$) 141% to 300% of the hole diameter ($D_{10}$).

11. The system of claim 1 wherein:
- the economizer comprises a vessel having:
  - a main cylinder (370) extending from the first end toward the second end; and
  - a second cylinder (380) at the second end and forming a sump (400), the liquid outlet extending from the sump.

12. The system of claim 1 wherein:
- the economizer lacks a spray bar and a wire mesh-type demister.

13. The system of claim 1 further comprising:
- a compressor (22) having:
  - an outlet (26) upstream of the condenser along the refrigerant flowpath (520);
  - a suction port (24) downstream of the second expansion device along a first branch (524) of the refrigerant flowpath; and
  - an economizer port (28) downstream of the economizer vapor outlet along a second branch (522) of the refrigerant flowpath.

14. The system of claim 13 being a chiller.

15. A method for using the system of claim 13, the method comprising:
- running the compressor to draw refrigerant from the suction port and the economizer port, compress said refrigerant, and drive the refrigerant downstream from the outlet along the refrigerant flowpath;

rejecting heat from the refrigerant in the condenser to water flowing along the condenser water path leg;

after the rejecting, expanding the refrigerant in the first expansion device;

passing the expanded refrigerant from the first expansion device to the flash tank economizer;

passing a first branch flow of the refrigerant from the flash tank economizer back to the economizer port;

passing a second branch flow of the refrigerant to the second expansion device;

passing the expanded refrigerant from the second expansion device to the evaporator;

absorbing heat by refrigerant passing through the evaporator from water passing along the evaporator water path leg; and returning refrigerant from the evaporator to the suction port.

16. The method of claim 15 wherein:

the medium is effective to remove droplets of liquid refrigerant from a vapor flow passing to the vapor outlet and deliver said droplets to a liquid accumulation for forming a liquid flow from the liquid outlet.

17. The method of claim 16 wherein:

refrigerant discharged from the inlet conduit outlet is deflected off an interior surface of the body at the first end.

18. An economizer comprising:

an elongate body having a first end (108) and a second end (110);

an inlet conduit (120) having an outlet (122);

a liquid outlet (66);

a vapor outlet (64); and first (160) and second (162) flat spaced-apart foraminate plates between the outlet of the inlet conduit and the liquid outlet.

19. The economizer of claim 18 wherein:

the plates parallel and spaced-apart from each other by a gap of 10 mm to 25 mm.

20. The economizer of claim 18 wherein:

holes (170) of the first plate are offset from holes (170) of the second plate.

* * * * *